US011450454B1

(12) United States Patent
Spruell et al.

(10) Patent No.: US 11,450,454 B1
(45) Date of Patent: Sep. 20, 2022

(54) OSCILLATING FLUTED OUTER COVERING FOR REDUCED WIND DRAG

(71) Applicant: Southwire Company, LLC, Carrollton, GA (US)

(72) Inventors: Stephen Spruell, Carrollton, GA (US); Jones M. Kithuka, Carrollton, GA (US)

(73) Assignee: Southwire Company, LLC, Carrollton, GA (US)

( * ) Notice: Subject to any disclaimer, the term of this patent is extended or adjusted under 35 U.S.C. 154(b) by 47 days.

(21) Appl. No.: 16/516,924

(22) Filed: Jul. 19, 2019

Related U.S. Application Data

(60) Provisional application No. 62/701,047, filed on Jul. 20, 2018.

(51) Int. Cl.
*H01B 7/18* (2006.01)
*H01B 7/28* (2006.01)
*H01B 11/04* (2006.01)

(52) U.S. Cl.
CPC ..... *H01B 7/184* (2013.01); *H01B 7/187* (2013.01); *H01B 7/1855* (2013.01); *H01B 7/28* (2013.01); *H01B 11/04* (2013.01)

(58) Field of Classification Search
CPC ..... H01B 7/18; H01B 7/184; H01B 7/1855; H01B 7/187; H01B 7/28
See application file for complete search history.

(56) References Cited

U.S. PATENT DOCUMENTS 4,474,426 A * 10/1984 Yataki ..... G02B 6/4407 385/111
4,795,230 A * 1/1989 Garcia ..... G02B 6/4407 242/128
2002/0129967 A1* 9/2002 Fett ..... H01B 7/184 174/112
2003/0099447 A1* 5/2003 Stingl ..... G02B 6/4408 385/110
2004/0156601 A1* 8/2004 Koyasu ..... G02B 6/4491 385/100
2007/0209824 A1* 9/2007 Stutzman ..... H01B 11/04 174/113 R
2012/0063732 A1* 3/2012 Wu ..... G02B 6/4408 385/104
2013/0126209 A1* 5/2013 Heffner ..... H01B 13/14 174/113 R

* cited by examiner

*Primary Examiner* — Paresh Paghadal
(74) *Attorney, Agent, or Firm* — Merchant & Gould P.C.

(57) ABSTRACT

A cable that extends along a longitudinal axis between a first end and a second end. The cable includes a jacket defined about the longitudinal axis. The jacket includes a plurality of fluting elements between the cable first end and the cable second end. The fluting elements are configured to reduce the torsional forces of cross-wind.

19 Claims, 12 Drawing Sheets

OSCILLATING FLUTED OUTER COVERING FOR REDUCED WIND DRAG

PRIORITY CLAIM AND CROSS-REFERENCE

This application claims priority to U.S. Provisional Application No. 62/701,047, titled "Oscillating Fluted Outer Covering for Reduced Wind Drag" filed on Jul. 20, 2018, the disclosure of which is hereby incorporated by reference in its entirety.

BACKGROUND

Kite power technology generates electricity through wings or kites, linked to the ground by tethers (or cables), which reach altitudes of about 800-1000 m above the ground. At these high elevations, cross winds are strong and constant. This strong and consistent wind force provides for increased power generation from the kite, but also causes stress to the tethers which both hold the kites and generate the power through resistance mechanisms on the ground. As a result, it is important for the tethers to be durable and efficient.

Air exerts a drag force on any object moving through it by directly opposing motion. A moving object has a high-pressure area on its front side. Air flows smoothly over the contours of the front side and eventually separates from the object toward the back side. A moving object also leaves behind a turbulent wake region where the air flow is fluctuating or agitated, resulting in lower pressure behind it. The size of the wake affects the amount of drag on the object. Due to the high speeds incurred during operation of kite power technology there is a strumming effect (Aeolian vibration) as the tether whips through the air.

And, the amount of surface over which the air flow must travel also affects the amount of wake, such that a greater amount of smooth surface creates a greater amount of wake, and thus a greater amount of drag. Surface depressions on an object travelling through air create a thin turbulent boundary layer of air that clings to the surface. This allows the smoothly flowing air to follow the surface farther around the back side of the object, thereby decreasing the size of the wake, and thus decreasing the drag.

Cross wind can cause torsion, which increases member shear stress. This stress is added to the existing shear stress due to vertical and lateral applied loads. A fluted exterior profile when subjected to crosswinds has been shown to lower the drag force on cylindrical objects by inducing turbulent flow across the object which reduces drag force on the object. A unidirectional helical profile can present an issue of inducing a torsional "wind up and release" which is not desirable. Example "wind up and release" can produce a cyclic torsional stress loading which can be detrimental to the service life of the components comprising a tether cable.

SUMMARY

An aspect of the present disclosure relates to a cable extending along a longitudinal axis between a first end and a second end. The cable includes an outer jacket defined about the longitudinal axis. The jacket includes a plurality of fluting elements between the cable first end and the cable second end. The fluting elements are configured to reduce the drag forces, and the torsion along the cable axis result from the cross-wind.

DETAILED DESCRIPTION

Figure 1:
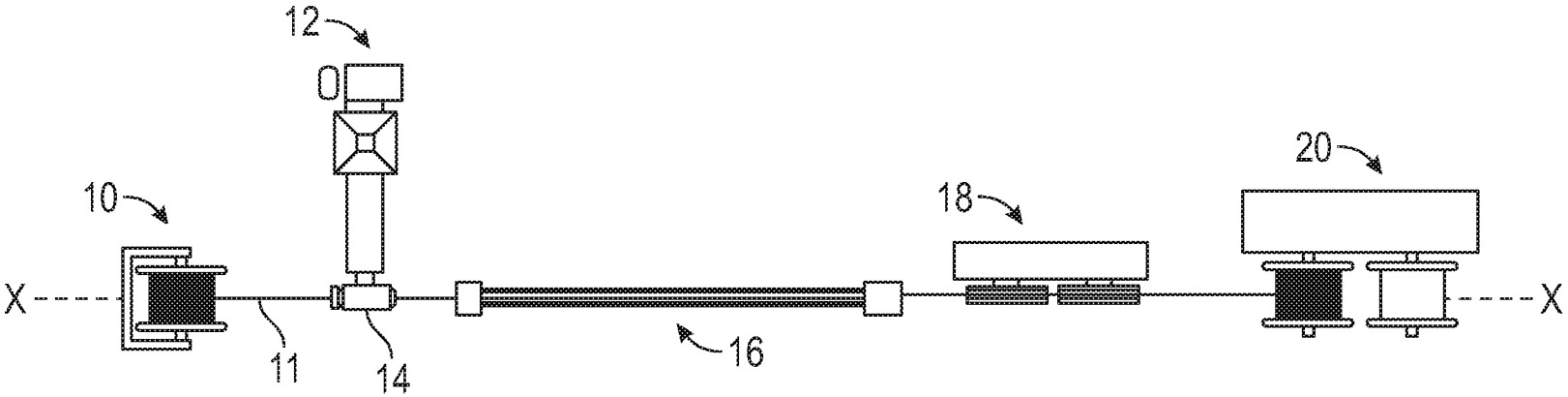
FIG. 1 (Prior Art)
FIG. 1 is a schematic diagram of an extrusion line system.

FIG. 1 illustrates an example extrusion line for jacketing a cable. Oriented along an axis X, the illustrated extrusion line includes a pay-off 10, an extruder 12, a cooling/curing trough 16, at least one capstan 18, and a take-up 20. The pay-off 10 is the starting point of the extrusion line. The pay-off 10 feeds a length of cable core 11 to the rest of the extrusion line. The extruder 12 includes a cross head 14 through which the length of cable core 11 extends. The extruder 12 forms a jacket to be applied onto the cable core 11 as it passes through the extruder cross head 14. An example jacket can be thermoplastic material which is applied onto the cable core 11. After passing through the extruder cross head 14, the cable core 11 is directed through the cooling/curing trough 16 to allow the jacketing material to cool and cure onto the cable core. The jacketed cable core 11 is pulled by the at least one capstan 18, which pulls the cable core away from the pay-off 10, through the extruder cross head 14 and the cooling/curing trough 16 and is finally fed to the take-up 20. Alternative embodiments can include multiple capstans, which can function both before and after the extruder along the extrusion line. An example capstan 18 can be a series of pulleys positioned vertically or horizontally. The final dimensions of the jacketed cable core 11 can be manipulated by adjusting the pulling speed of the capstan 18.

An example cable (or tether) core can have a carbon fiber construction insulated with an aluminum fluoropolymer, for example the TEFZEL™ product. The outer jacket can be constructed of material capable of having a fluid state and a solid state. Examples of such outer jacket material include thermoplastics, such as PVC, polyurethane, polyethylene, polypropylene, nylon and silicone rubber.

An example cable can have fluting elements extending on the jacket to reduce drag from cross-winds, thus increasing efficiency of the system and therefore higher energy gains by the system. This design can create more turbulent flow at the surface of the tether, resulting in lower resultant drag from the crosswind. This design forces the boundary layer of the airflow around the tether for lower drag. This proposed designs minimize strumming from coordinated vortex shedding.

Figure 2:
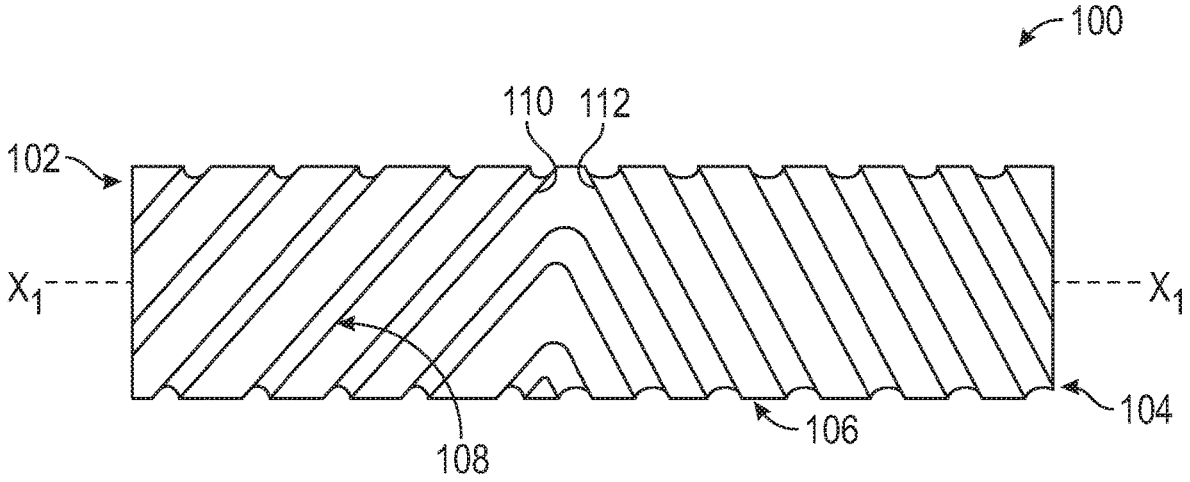
FIG. 2 is a schematic diagram of a first example fluting element pattern on an outer jacket of a conductor cable, according to an embodiment of the present disclosure.

FIG. 2 illustrates an example cable 100 (or tether) which can be constructed by an extrusion line, for example the extrusion line described in FIG. 1. The illustrated cable 100 can extend between a first end 102 and a second end 104, and can be oriented along an axis $X_1$. The cable 100 is covered by a jacket 106 which is circumferentially arranged about the axis $X_1$.

The illustrated cable 100 can include oscillating helical fluting features 108 on the outer surface 106. This example cable 100 includes a plurality of oscillating helical fluting features 108 extending in parallel to each other from the first end 102 to the second end 104. An example cable can include between about 1 and about 40 parallel fluting features 108, more preferably between about 10 and about 30 parallel fluting features, and most preferably about 20 parallel fluting features. Each one of the oscillating helical fluting features 108 can alternate (from the first end 102 to the second end 104) between counter-clockwise oriented sections 110 and clockwise oriented sections 112, and vice versa. The sections of the oscillating helical fluting features 108 can extend at an acute angle orientation with respect to the axis $X_1$, and can alternate in direction between the counter-clockwise section 110 and the clockwise section 112.

The oscillating helical profile can reduce the potential for torsional "wind up and release," since the net torsion created by wind traveling down the helical profiles (while the direction reverses periodically) counteracts the torsion, resulting in almost a net zero torsion on the cable along the axis.

An example fluting feature 108 can be a groove in the jacket 106. The grooves can have a depth of between about 0.1 mm and about 1.0 mm, preferably between about 0.3 mm and 0.7 mm, and more preferably about 0.5 mm. The grooves can be semi-circular, with a diameter of between about 0.1 mm and about 1.0 mm, preferably between about 0.3 mm and 0.7 mm, and more preferably about 0.5 mm.

Alternatively, the fluting features 108 can be grooves with alternative geometries, for example square, or triangular.

An example jacket can have a thickness of between about 0.1 mm and about 3.0 mm, preferably between about 1.0 mm and about 2.0 mm, and more preferably about 1.5 mm. The ratio between the depth of the fluting features 108 to the thickness of the jacket can be between 1:4 and 1:2, and more preferably about 1:3.

An example jacket can have a diameter of between about 20 mm and about 40 mm, preferably between about 25 mm and about 35 mm, and more preferably about 31 mm. The ratio between the depth of the fluting features 108 to the diameter of the jacket 106 can be between about 1:20 to about 1:400, preferably between about 1:50 to about 1:83, and more preferably about 1:62. Thus more preferably, the depth of the fluting features 108 can be about 1.6% of the diameter of the jacket 106.

The thickness of the outer jacket 106 can be between about 10% and about 70%, preferably between about 20% and about 60%, and more preferably about 30% of the diameter of the cable core 100.

Figure 3:
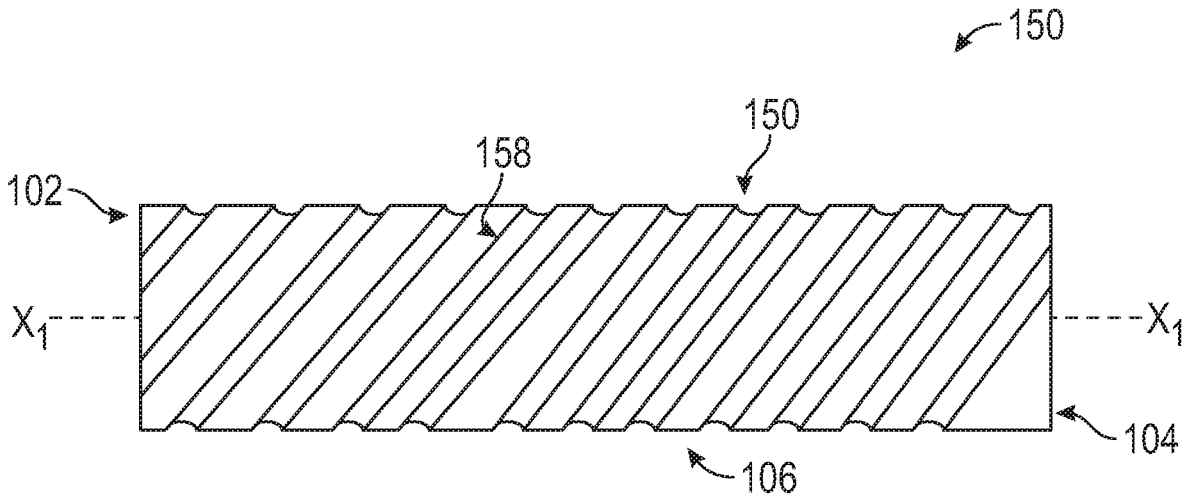
FIG. 3 is a schematic diagram of a second example fluting element pattern on an outer jacket of a conductor cable, according to another embodiment of the present disclosure.

FIG. 3 illustrates another example cable 150 which can be constructed by the extrusion line described in FIG. 2. Similarly to the cable (100) above, the illustrated cable 150 can extend between a first end 102 and a second end 104, and can be oriented along an axis $X_1$. The cable 150 is covered by a jacket 106 which is circumferentially arranged about the axis $X_1$. The cable 150 can have fluting features 150 extending in a parallel spiral geometry on the jacket 160. The fluting features 150 can be grooves with similar characteristics and dimensions as the grooves described above in FIG. 2.

Figure 4:
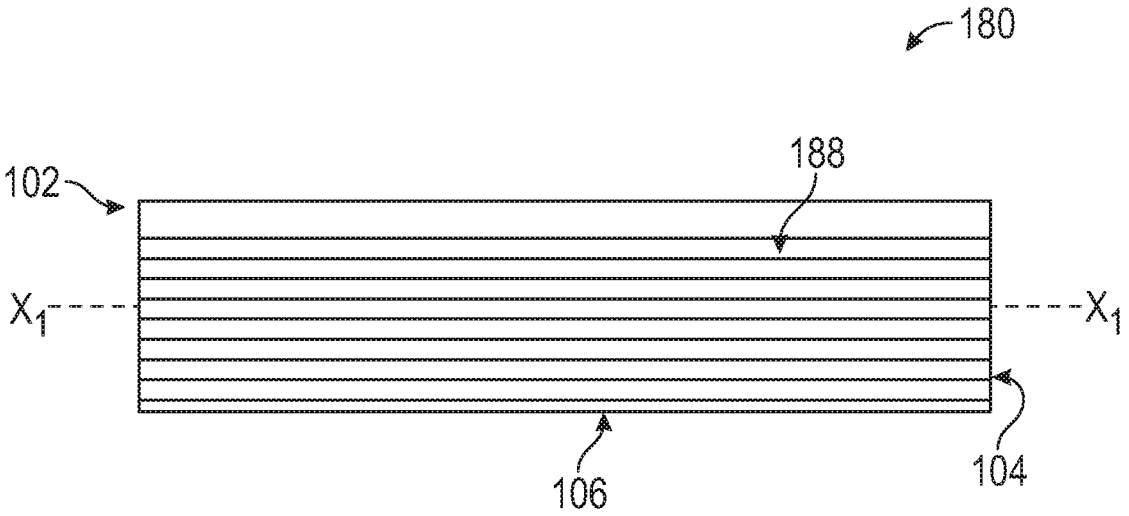
FIG. 4 is a schematic diagram of a third example fluting element pattern on an outer jacket of a conductor cable, according to another embodiment of the present disclosure.

FIG. 4 illustrates another example cable 180 which can be constructed by the extrusion line described in FIG. 2. Similarly to the cable (100) above, the illustrated cable 180 can extend between a first end 102 and a second end 104, and can be oriented along an axis $X_1$. The cable 180 is covered by a jacket 106 which is circumferentially arranged about the axis $X_1$. The cable 180 can have fluting features 150 extending in an elongated orientation parallel to the axis $X_1$ on the jacket 160. The fluting features 180 can be grooves with similar characteristics and dimensions as the grooves described above in FIG. 2.

Figure 5:
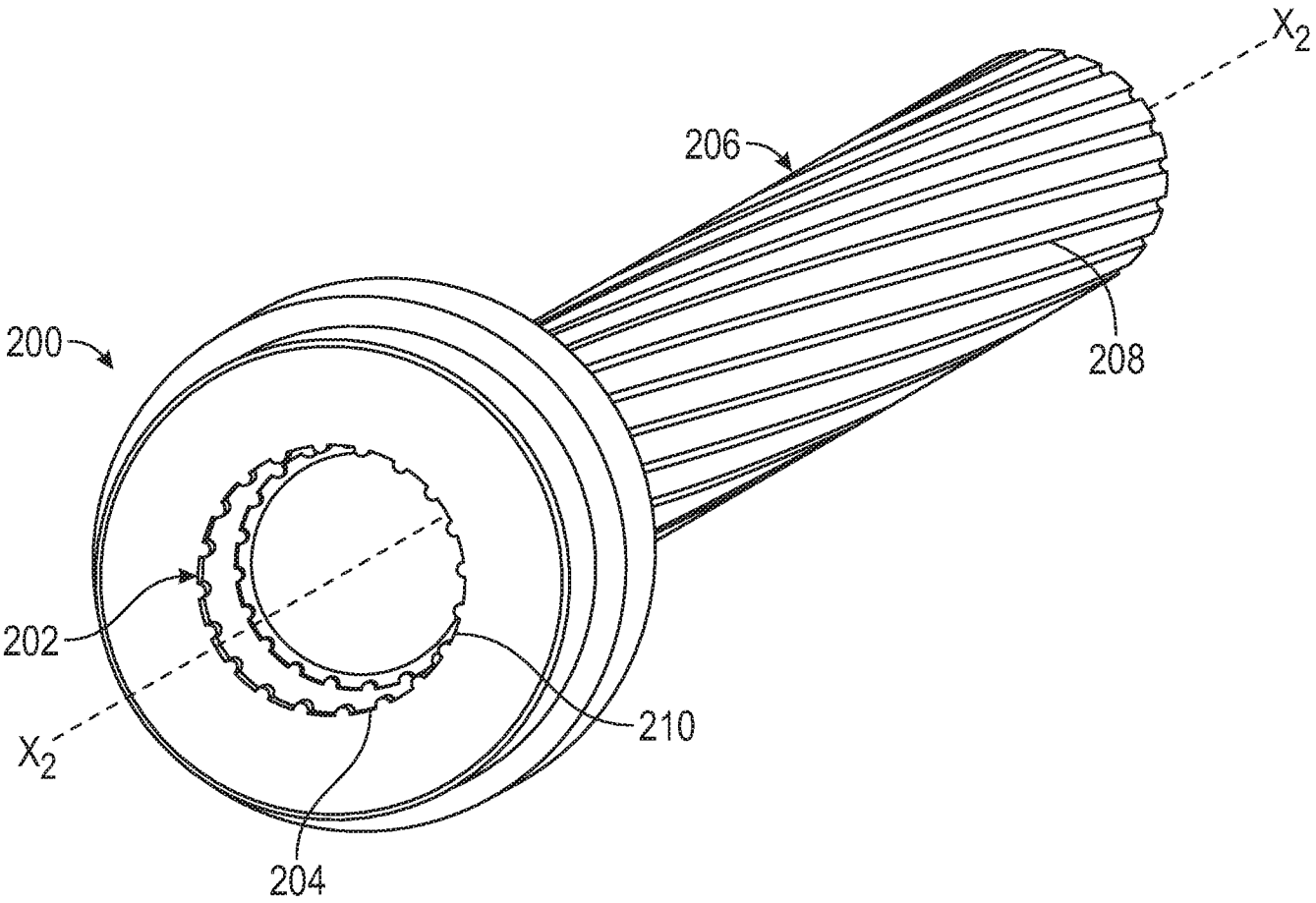
FIG. 5 is a schematic diagram of a die profile system for generating the fluting element patterns in FIGS. 2-4, according to another embodiment of the present disclosure.

There are several possible solutions to achieve the fluted outer jackets described above. A first example can be an extrusion line system, such as the example described in FIG. 1, with an extrusion die supported in the extruder head (14) to generate the fluting elements during the application of the jacket onto the cable core. FIG. 5 illustrates an example extrusion die 200 that can form an outer jacket 206 having a plurality of fluting elements 208, similar to those described in FIGS. 2-4. The extrusion die 200 is oriented to receive a cable core (11) and distribute the cable core with the outer jacket 206 along an axis $X_2$, which can be equivalent to axes X and $X_1$ described in FIGS. 1-4.

The illustrated extrusion die 200 includes a die profile 202 which can be a passageway or aperture through which the cable core can pass after being coated with a hot liquid material that forms the outer jacket. The die profile 202 can have an outer circumference 210 intersected by a plurality of flanges (or teeth) 204 which extend inwardly from the outer circumference. The number of flanges 204 to be used is determined by the number of fluting elements 208 to be formed on the outer jacket 206 during extrusion. The outer circumference 210 of the die profile 202 is defined by a diameter that is determined by the preferred diameter of the outer jacket 206 to be formed. The distance which the plurality of flanges 204 extend inwardly from the outer circumference 210 is determined by the preferred depth of the fluting elements 208 to be formed in the outer jacket 206.

In use relative to the extrusion line in FIG. 1, the cable core 11 is inserted into the extruder cross head 14 of the extruder 12, where outer jacket material in a hot and liquid state is applied over the entire exterior surface of the cable core. While the outer jacket material is still in a liquid state, the jacketed cable core 11 is inserted through the die profile 202 of the extrusion die 200 supported within the extruder cross head 14. The outer circumference 210 and plurality of flanges 204 of the die profile 202 allow an amount of the outer jacket material to pass through with a geometry defined by the die profile. After passing through the extrusion die 200, the cable with a profiled outer jacket 206 having a plurality of fluting elements 208 is cooled and cured by the cooling/curing shaft 16 in order to transform the outer jacket material into a solid state.

When forming the outer jacket 106 having straight fluting elements 188, as illustrated in FIG. 4, the pay-off 10, the extruder 12, the cooling/curing shaft 16, the capstan 18, and the take-up 20 along the extrusion line (FIG. 1) remain in a fixed orientation with respect to the cable core 11.

When forming the outer jacket 106 having oscillating helical fluting elements 108, as illustrated in FIG. 2, the pay-off 10, the cable core 11, the cooling/curing shaft 16, the capstan 18, and the take-up 20 rotate alternately in clockwise and counter-clockwise directions along the extrusion line (FIG. 1) about the axis X with respect to the extruder 12 and cross head 14, which is maintained in a stable orientation relative to the axis. As the cable core 11 is progressing along the extrusion line, it is being rotated in an alternating clockwise and counter-clockwise manner all along the extrusion line. As it passes into the extrusion cross head 14 the outer jacket material is applied over the consistently rotating cable core 11. The cable core 11 covered with the liquid outer jacket material then passes through the die profile 202 (FIG. 5) along the axis while continuing to alternate clockwise and counter-clockwise rotation. This movement causes the die profile 202 to form the oscillating helix pattern of fluting elements 108 on the outer jacket 106.

When forming the outer jacket 106 having spiral fluting elements 158, as illustrated in FIG. 3, the pay-off 10, the cable core 11, the cooling/curing trough 16, the capstan 18, and the take-up 20 rotate consistently in either a clockwise or counter-clockwise directions along the extrusion line (FIG. 1) about the axis X with respect to the extruder 12 and cross head 14, which is maintained in a stable orientation relative to the axis. As the cable core 11 is progressing along the extrusion line, it is being rotated consistently in either a clockwise or counter-clockwise manner along the extrusion line. As it passes into the extrusion cross head 14 the outer jacket material is applied over the consistently rotating cable core 11. The cable core 11 covered with the liquid outer jacket material then passes through the die profile 202 (FIG. 5) along the axis while continuing to rotate either clockwise or counter-clockwise. This movement causes the die profile 202 to form the spiral pattern of fluting elements 158 on the outer jacket 106.

The reverse of the above is also effective, with the pay-off 10, the cable core 11, the cooling/curing trough 16, the capstan 18, and the take-up 20 remaining in a fixed orientation, while the extruder cross head 14 and profile die 202 rotate about the axis.

Figure 6:
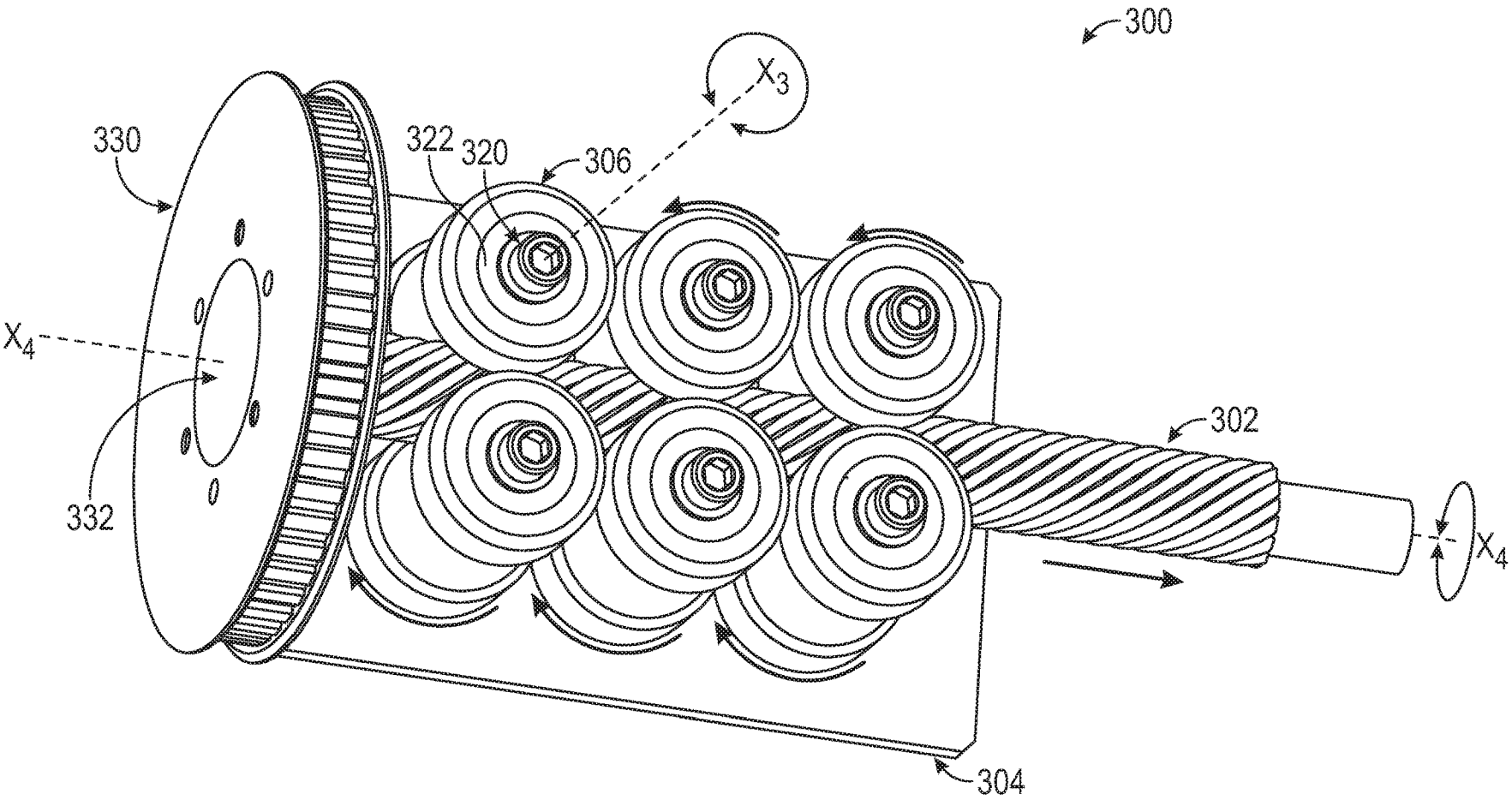
FIG. 6 is a schematic diagram of the top surface of a roller system for generating the fluting element patterns in FIGS. 2-4, according to another embodiment of the present disclosure.
Figure 7:
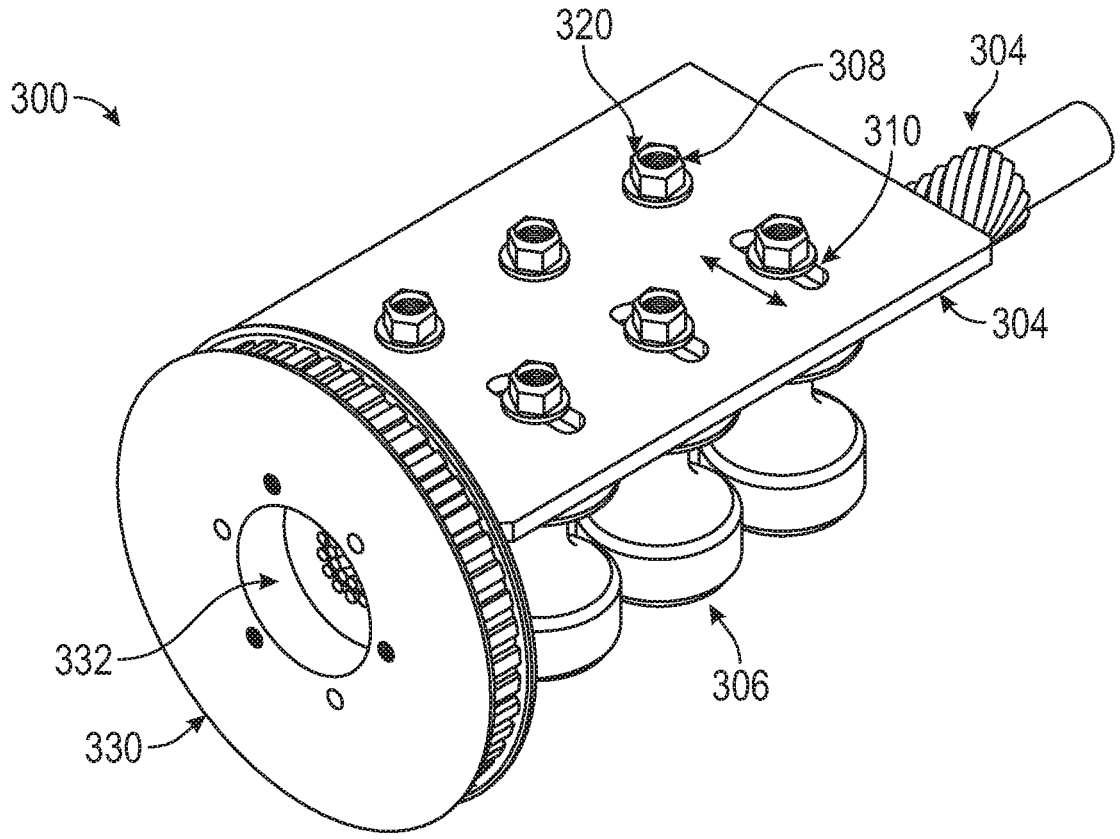
FIG. 7 is a schematic diagram of the bottom surface of the roller system shown in FIG. 6.
Figure 8:
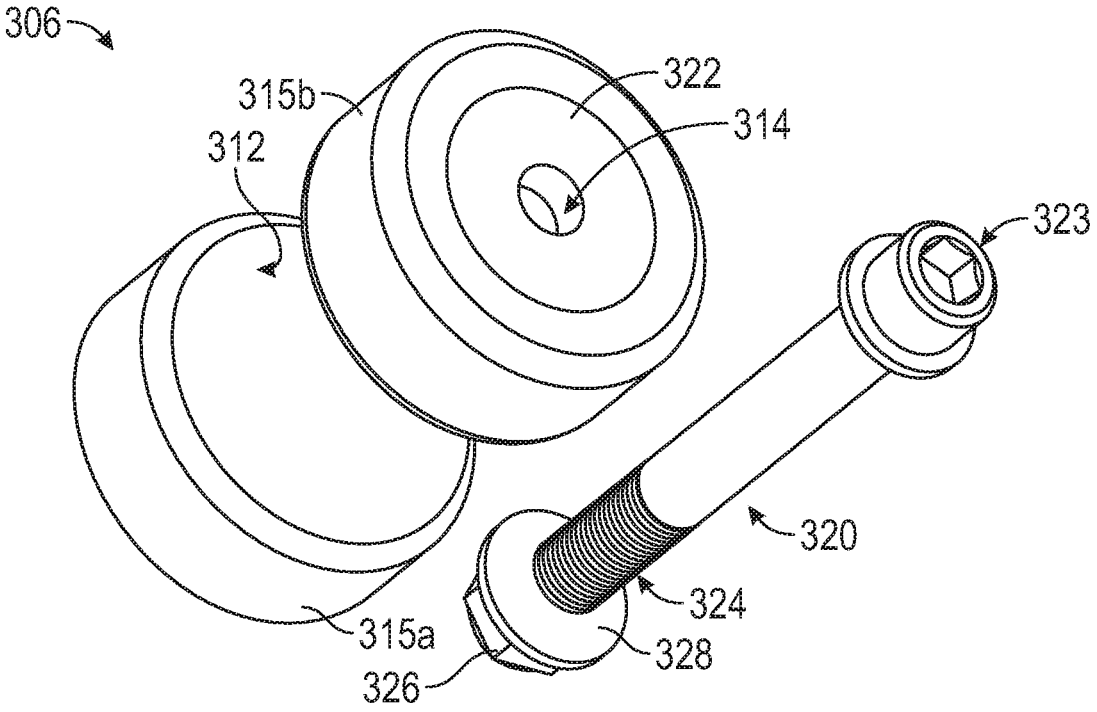
FIG. 8 is a schematic diagram of a roller shown in FIG. 6, shown isolated from the roller system.

FIGS. 6-8 illustrate a roller assembly 300 which can function to rotate a section of a cable core 302 in a clockwise and/or counter-clockwise direction about an axis $X_4$. Axis $X_4$ can extend in alignment with above axis X. Preferably, the roller assembly 300 can be introduced to the extrusion line in FIG. 1, after the pay-off 10 and before the extruder 12 and cross head 14. When using the roller assembly 300 the pay-off, the extruder 12, cross head 14, the cooling/curing trough 16, the capstan 18 and the take-up 20 can remain non-rotational about the axis X. The cable core 302 is gripped by a series of rollers 306 on the roller assembly 300. The series of rollers 306 are arranged by opposing pairs, each being rollably secured to a backing plate 304. The backing plate 304 is fixed, for example through welding, to a gear 330, for example a timing belt pulley. The gear 330 has an aperture 332 through which the cable core 304 extends along the axis $X_4$. Rotating the gear 330 in an oscillating clockwise and counter-clockwise manner about the axis $X_4$ causes the backing plate 304 to rotate in an oscillating clockwise and counterclockwise manner, thus causing the core 302 to rotate as the fluted jacket profile is applied. The resultant profile out of the extruder 12 and cross head 14 is an oscillating helical direction profile.

Each roller 306 is oriented along an axis $X_3$ extending from the backing plate 304 and is supported with respect to a position on the backing plate with a fastener 320. The backing plate 304 can have a series of apertures, arranged to adjust the position of paired rollers 306 with respect to each other. A first fixed position aperture 308 receives a fastener 320 to fix a first roller 306 in a fixed position on the backing plate 304. A second sliding (or translating) position aperture 310 can have an elongated geometry that provides freedom for a fastener 320 to alter its position with respect to the first fixed position aperture 308. In use, a fastener 320 in the second sliding position aperture 310 fastens to a second roller 306 and allows this second roller to move (or translate) relative to an opposing first roller fastened through the first fixed position aperture 308. Such movement of relative position between a pair of opposing first and second rollers 306 provides an adjustment in gripping force applied by the rollers to a cable core 302.

FIG. 8 illustrates an example of the rollers 30 from the roller assembly 300. The example roller 306 can have a receiver (or connector) 312 set between a pair of barriers 315*a*, 315*b*. The receiver 312 can have a curved and reduced diameter geometry extending between the pair of barriers 315*a*, 315*b*. The diameter of the receiver 312 surface is substantially similar to the diameter of the cable core 302. And, the depth from the widest portion of each barrier 315*a*, 315*b* to the shallowest portion in the receiver 312 is substantially similar to the radius (half the diameter) of the cable core 302. The receiver 312 can be lined with a durable material, such as neoprene.

A pair of opposing rollers 306 on the roller assembly 300 grip the cable core 302 between the opposing receivers 312 of each roller, with the opposing pair of barriers 315*a*, 315*b* preventing the cable core from accidentally being removed. The pair of opposing receivers 312 of opposing rollers 306 engages and applies pressure to the outer surface of the cable core 302. When received between a pair of opposing receivers 312, the cable core 302 can still progress along the extrusion line (FIG. 1) because each roller 306 can still rotate about axis $X_3$.

The roller 306 can have an aperture 314 between the barriers 315*a*, 315*b*. The aperture 314 can receive the fastener 320 that is inserted through one of the apertures 308, 310 in the backing plate 304 in order to support the roller with respect to the backing plate. The fastener 320 can be a bolt that includes a threaded insertion portion 324 and a gripping end 324. The gripping end 324 can include a nut-like element and a washer-like element, which do not pass through the aperture 314 in the roller 306 when the fastener 320 is inserted therein. When inserted, the gripping end 323 contacts a bearing 322 that is rotatably fitted into a recessed receiver in one of the barriers 310*b*.

The threaded insertion portion 324 of the fastener 320 is inserted through the aperture 314 in the roller 306 and through either the fixed aperture 308 or the sliding position aperture 310 in the backing plate 304. A locknut 326 secures to the threaded insertion portion 324 of the fastener 320 on the opposite side of the backing plate 304. A washer 328 can fit over the fastener 320 to prevent the locking nut 326 from passing through the aperture 308, 310 in the backing plate 304. When supported to the backing plate 304 by the fastener 320, the roller 306 can freely rotate about axis $X_3$ with respect to the backing plate, with each roller in an opposing pair rotating in opposite directions to each other.

When the pair of opposing rollers 306 are to closer each other, the amount of gripping force applied to the cable core 302 is increased. When the pair of opposing rollers 306 are farther apart from each other, the amount of gripping force applied to the cable core 302 is decreased. When gripped with sufficient force by the opposing pair of rollers 306, the cable core 302 can be twisted clockwise or counter-clockwise by rotating the roller assembly 300 in a similar direction. Preferably, rotation of the roller assembly 300 will cause a specific section of the cable core 302 to rotate immediately before and after passing through the extrusion cross head 14 without rotating the entire cable core. Such limited twisting assists in achieving higher line speeds and lowers cost.

Figure 9:
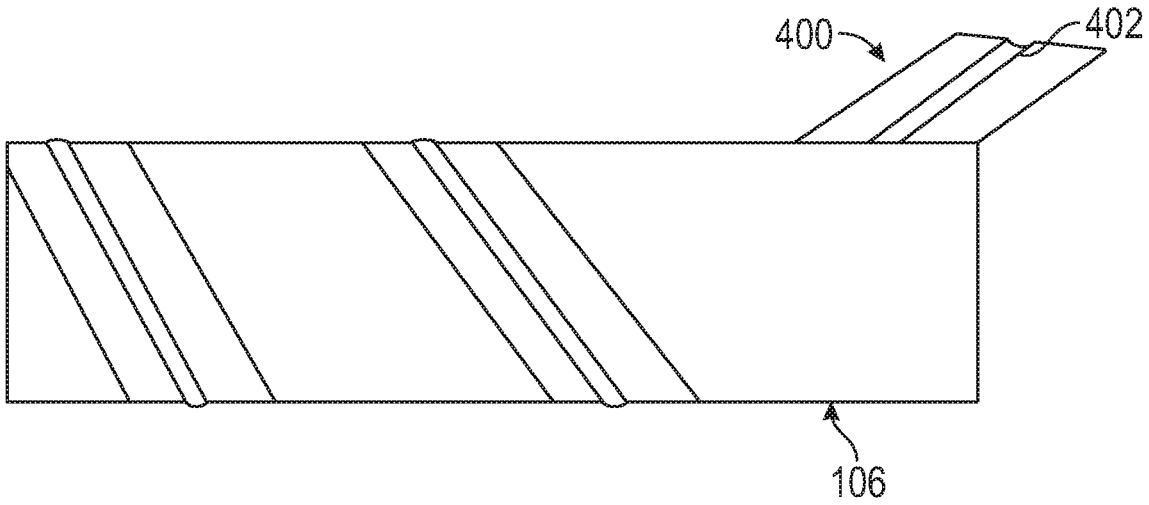
FIG. 9 is a schematic diagram of a tape application system for generating the fluting element patterns in FIGS. 2-4, according to another embodiment of the present disclosure.

FIG. 9 illustrates another system that can add fluting elements to the outer jacket of a cable. Instead of utilizing the die profile above, the fluting elements can be applied to the liquid jacketing material before cooling/curing through a length of tape, which holds solid elements in place on the jacket to create grooves. Example solid elements applied by tape can include yarns, rods or other materials. After the cable core is covered with liquid jacketing material by the extruder, a length of tape 400 is continuously applied over the liquid material forming the jacket 106. The tape can be applied length-wise in parallel with the axis of the cable, wrapped around the jacket in a spiral fashion, or wrapped around the jacket in a helical manner. The tape 400 carries solid elements 402 which press into the liquid material of the jacket 106, forming a groove, similarly to those described above. After the jacket 106 has cooled and cured, the tape 400 is pulled away, also pulling the solid elements 402 away from the jacket. Once the tape 400 and solid elements 402 have been removed, the jacket 106 is left with a plurality of fluting elements, such as grooves, in the jacket. The tape 400 can be applied, for example with a dispenser, within the extrusion cross head after the liquid material has been applied, thus being at a location similar to where the die profile would have been in the above examples.

Figure 10:
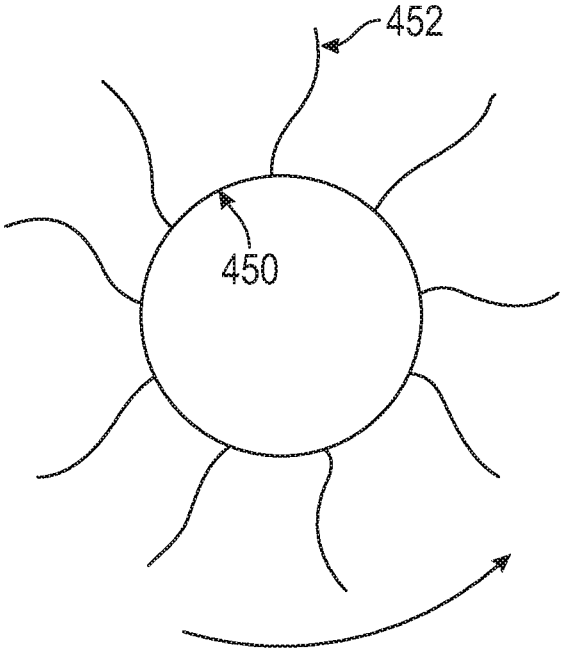
FIG. 10 is a schematic diagram of a yarn system for generating the fluting element patterns in FIGS. 2-4, according to another embodiment of the present disclosure.

FIG. 10 illustrates another system for producing fluting elements on a jacket using strippable yarns. Strippable yarns 452 may be applied onto the hot jacket using a rotating ring 450 to oscillate the yarns. The yarns 452 can then be pressed down into the jacket and then stripped off after cooling/curing once the jacket has cured and cooled. Once removed, the striped yarns 452 leave a fluted element design on the jacket. The ring 450 and strippable yarns 452 can be introduced during the extrusion line, similarly to the tape application example described above.

Figure 11:
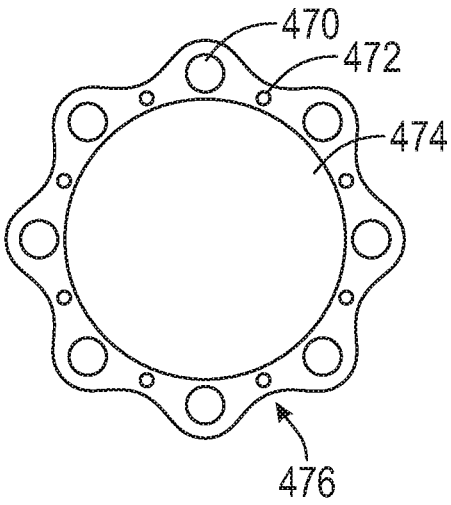
FIG. 11 is a schematic diagram of a filler system for generating the fluting element patterns in FIGS. 2-4, according to another embodiment of the present disclosure.

FIG. 11 illustrates a further system that introduces stranding with fillers 472 about the cable core 474. When conductors 470 are stranded around the core 474, fillers 472 with smaller diameter than the conductors can be used as spacers and stranded in an alternating orientation. After the jacketing process, as described in FIG. 1 above, the lower height of the fillers 472 create valleys (or voids) 476 in the jacket which become fluting elements. Since the insulated conductors 470 and filler 472 strands have a lay length, the fluting elements extend in a spiral orientation along the length of the cable.

Figure 12:
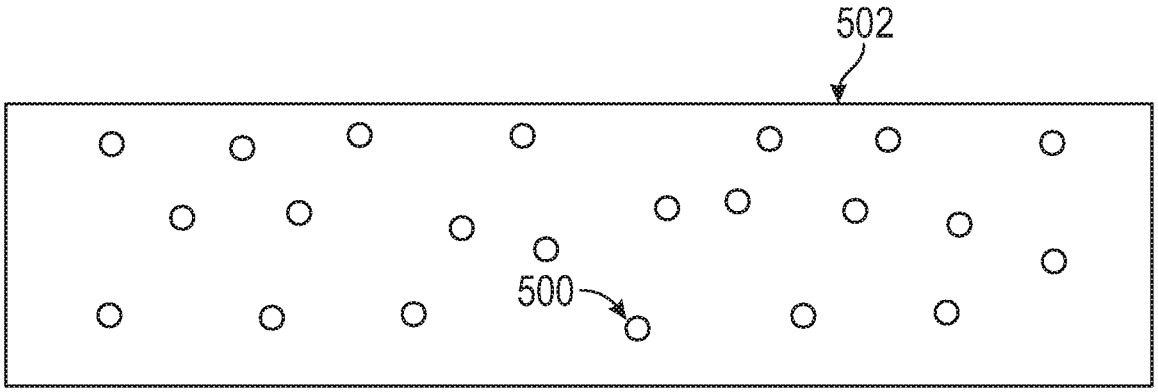
FIG. 12 is a schematic diagram of a water-soluble sphere system for generating fluting element patterns, according to another embodiment of the present disclosure.

FIG. 12 illustrates a further system which includes introducing a plurality of water soluble spheres 500 to create dimples on the jacket 502, similarly to the surface of a golf ball. Each dimple can have a diameter of between 0.1 mm and about 5 mm, preferably between about 1 mm and about 4 mm, and more preferably between about 2 mm and about 3 mm. The thickness of the outer jacket 502 can be between about 10% and about 70%, preferably between about 20% and about 60%, and more preferably about 30% of the diameter of the cable core. The concentration of the dimples (in total) over the outer surface of the outer jacketing should be between about 10% to about 99% of the surface area, preferably between about 25% to about 75%, and more preferably about 50% of the surface area of the outer jacketing. The dimples can form a variety of patterns, which can be symmetrical and asymmetrical, random waves, circles and symbols. The dimples act as fluting elements, and can provide a similar effect on cross-wind as the grooves described above.

A water-soluble compound in the shape of sphere 500 is introduced to the jacketing material during the extrusion process, such as the extrusion line in FIG. 1. These spheres 500 are naturally forced to the surface after going through a die and dissolve on contact with water in the cooling/curing trough. The dissolved compound leave dimples in the jacket 502 where the spheres were. The spheres may be made of salts such as sodium chloride impregnated with fibers to increased density and stability during extrusion process.

The dimples can also be formed by blowing agents, for example chemical blowing agents that decompose due to heat may be used to create the dimples. Such compounds, for example triazoles and nitrogen, may be dispersed in the compound and when the correct temperature and pressure is reached during extrusion they give off gas. The gases form cells or bubbles, which if large enough, will come to the surface and appear as dimples.

Instead of using dimples to create turbulent flow around the extruded surface, the reverse of dimples could be applied. By creating little bumps on the surface of the cable laminar flow of air will be lost at high speeds as the cable whips through the air. These bumps, or reverse dimples, may be introduced during the extrusion process. They may be made of glass bubbles or any other light weight material like recycled fluoropolymers that require elevated melt temperatures.

Figure 13:
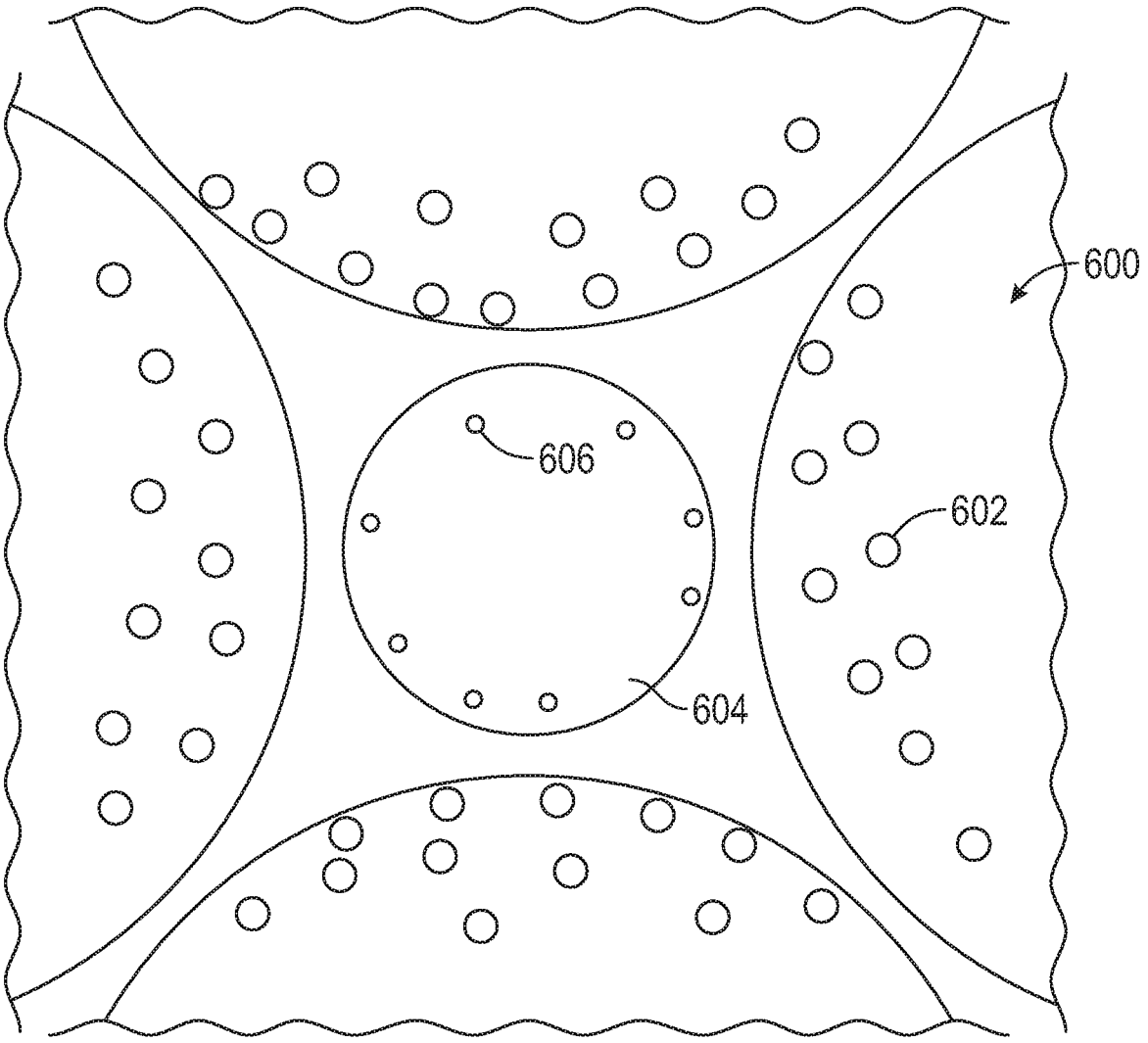
FIG. 13 is a schematic diagram of a heated roller system for generating fluting element patterns, according to another embodiment of the present disclosure.

FIG. 13 includes a further system which uses a series of heated rollers 600 with a plurality of nodes 602 to melt impressions of dimples 606 onto the jacket 604. Example rollers 600 can be of different shapes and orientation with nodes 602 of same or varying sizes. The heated rollers 600 can function along the extrusion line shown in FIG. 1, after the jacket has cooled/cured in the cooling/curing trough. The dimples 606 on the jacket 604 can function similarly to the dimples described above.

The above specification, examples and data provide a complete description of the manufacture and use of the composition of the invention. Since many embodiments of the invention can be made without departing from the spirit and scope of the invention, the invention resides in the claims hereinafter appended.

Embodiments of the disclosure may comprise a cable extending along a longitudinal axis between a first end and a second end, the cable comprising jacket defined about the longitudinal axis, the jacket comprising a plurality of dimples between the cable first end and the cable second end, the dimples being configured to reduce the torsional forces of cross-wind.

Embodiments of the disclosure may comprise a system for creating a cable with a core and an outer jacket that reduces torsion from cross winds, the system comprising a plurality of water-soluble spheres which form dimples in the outer jacket when exposed to water.

Embodiments of the disclosure may comprise a system for creating a cable with a core and an outer jacket that reduces torsion from cross winds, the system comprising a plurality of heated rollers comprising a plurality of nodes, wherein the plurality of rollers are configured to melt the outer jacket and form a plurality of dimples in the outer jacket.

What is claimed is:

1. A cable comprising:

a cable core extending along a longitudinal axis between a first end and a second end; and a jacket circumferentially arranged over the cable core, the jacket comprising a plurality of helical fluting elements on an outer surface of the jacket, the plurality of helical fluting elements extending in parallel between the first end of the cable core and the second end of the cable core, wherein the plurality of helical fluting elements comprises grooves, wherein the grooves are semicircular with a diameter of between 0.1 mm and 1.0 mm, wherein a thickness of the jacket is between 0.1 mm and 3.00 mm, and wherein a ratio between a depth of the plurality of helical fluting elements to a diameter of the jacket is in a range of 1:20 to 1:400.

2. The cable of claim 1, wherein the plurality of helical fluting elements comprises at least one oscillating helix that extends in alternating clockwise and counterclockwise orientations about the longitudinal axis.

3. The cable of claim 1, wherein the grooves are arranged in parallel about the longitudinal axis.

4. The cable of claim 1, wherein the grooves extend in a coil shape.

5. The cable of claim 1, wherein a depth of the grooves is between 0.3 mm and 0.7 mm.

6. The cable of claim 1, wherein the grooves are semicircular with a diameter of between 0.3 mm and 0.7 mm.

7. The cable of claim 1, wherein the thickness of the jacket is between 1.00 mm and 2.00 mm.

8. The cable of claim 1, wherein a ratio between the depth of the plurality of helical fluting elements and the thickness of the jacket is between 1:4 and 1:2.

9. The cable of claim 1, wherein the thickness of the jacket is between 10% and 70% of a diameter of the cable core.

10. The cable of claim 1, wherein the thickness of the jacket is between 20% and 60% of a diameter of the cable core.

11. A cable comprising:

a cable core; and a jacket circumferentially arranged over the cable core, the jacket comprising a plurality of helical fluting elements on an outer surface of the jacket, the plurality of helical fluting elements extending in parallel between the first end of the cable core and the second end of the cable core, wherein a thickness of the jacket is between 10% and 70% of a diameter of the cable core, wherein the plurality of helical fluting elements comprises grooves, wherein the grooves are semicircular with a diameter of between 0.1 mm and 1.0 mm, and wherein a ratio between a depth of the plurality of helical fluting elements to a diameter of the jacket is in a range of 1:20 to 1:400.

12. The cable of claim 11, wherein the grooves are semicircular with a diameter of between 0.3 mm and 0.7 mm.

13. The cable of claim 11, wherein the thickness of the jacket is between 0.1 mm and 3.00 mm.

14. The cable of claim 11, wherein the thickness of the jacket is between 1.00 mm and 2.00 mm.

15. The cable of claim 11, wherein a ratio between the depth of the plurality of helical fluting elements and the thickness of the jacket is between 1:4 and 1:2.

16. The cable of claim 11, wherein the plurality of helical fluting elements comprises at least one oscillating helix that extends in alternating clockwise and counterclockwise orientations about the longitudinal axis.

17. The cable of claim 11, wherein the grooves are arranged in parallel about the longitudinal axis.

18. The cable of claim 11, wherein the grooves extend in a coil shape.

19. The cable of claim 11, wherein the thickness of the jacket is between 20% and 60% of a diameter of the cable core.

* * * * *